US009968817B2

(12) United States Patent
Fields, I

(10) Patent No.: US 9,968,817 B2
(45) Date of Patent: May 15, 2018

(54) UNIBODY FITNESS SYSTEM

(71) Applicant: Freeman D. Fields, I, Atlanta, GA (US)

(72) Inventor: Freeman D. Fields, I, Atlanta, GA (US)

( * ) Notice: Subject to any disclaimer, the term of this patent is extended or adjusted under 35 U.S.C. 154(b) by 0 days. days.

(21) Appl. No.: 13/999,183

(22) Filed: Jan. 27, 2014

(65) Prior Publication Data

US 2015/0209607 A1 Jul. 30, 2015

(51) Int. Cl.

| | |
|---|---|
| ***A61F 5/00*** | (2006.01) |
| ***A63B 21/008*** | (2006.01) |
| ***A63B 21/012*** | (2006.01) |
| ***A63B 21/015*** | (2006.01) |
| ***A63B 69/00*** | (2006.01) |
| ***A63B 21/00*** | (2006.01) |
| ***A63B 23/12*** | (2006.01) |
| ***A63B 21/02*** | (2006.01) |

(52) U.S. Cl.

CPC ..... *A63B 21/008* (2013.01); *A63B 21/0004* (2013.01); *A63B 21/00069* (2013.01); *A63B 21/022* (2015.10); *A63B 21/4011* (2015.10); *A63B 21/4017* (2015.10); *A63B 23/1281* (2013.01); *A63B 69/0028* (2013.01)

(58) Field of Classification Search

CPC . A63B 21/0081; A63B 21/026; A63B 21/045; A63B 21/1423; A63B 21/1434; A63B 21/1476; A63B 21/1492; A63B 23/0494; A63B 23/1281; A63B 21/1449; A63B 21/008; A63B 21/015; A63B 21/05; A63B 21/028; A63B 21/1403; A63B 21/0004; A63B 21/4049; A61F 5/00; A61F 5/01; A61F 5/0102; A61F 5/0123; A61F 5/13; A61F 2005/0132

See application file for complete search history.

(56) References Cited

U.S. PATENT DOCUMENTS

| | | | | | |
|---|---|---|---|---|---|
| 4,171,802 | A * | 10/1979 | Stoecker | A63B 23/14 482/112 |
| 5,443,444 | A * | 8/1995 | Pruyssers | 602/26 |
| 5,749,840 | A * | 5/1998 | Mitchell et al. | 602/5 |
| 6,022,300 | A * | 2/2000 | Hightower | 482/106 |
| 2004/0267177 | A1* | 12/2004 | Houser | 602/16 |
| 2011/0071450 | A1* | 3/2011 | Chiang et al. | 602/16 |
| 2011/0306911 | A1* | 12/2011 | Tran | 602/16 |
| 2013/0178771 | A1* | 7/2013 | Moir et al. | 602/16 |
| 2014/0094351 | A1* | 4/2014 | Cersonsky | 482/115 |
| 2014/0207038 | A1* | 7/2014 | Santaniello et al. | 602/16 |

* cited by examiner

*Primary Examiner* — Nyca T Nguyen
(74) *Attorney, Agent, or Firm* — Merchant & Gould P.C.

(57) ABSTRACT

The Unibody Fitness System allows an individual to receive the highly desirable low impact resistance of working out in a pool without actually being in water. With the Unibody Fitness System, the user can perform a complete workout regiment to build muscles without the use of weights or water as the system uses fluid to create resistance during cardiovascular workout, aerobics, walking, jogging or doing menial tasks. By attaching the Unibody Fitness System device to the body's joints and flex points, such as the elbow and knee, resistance is produce for the muscles in that region of the body every time the user bends or extends the arm or leg which the device is worn.

3 Claims, 4 Drawing Sheets

UNIBODY FITNESS SYSTEM

RELATED APPLICATIONS

This application is related to the provisional application Ser. No. 61/849,490 filed Jan. 28, 2013 entitled "Unibody Fitness System"

FIELD OF INVENTION

This disclosure relates generally to the technical field of body mechanics in performing athletic activities, such as aerobics, weightlifting, walking, running, riding, and fitness training, and in one example embodiment, to an exercise system for performing physical training and technique for working thereof. More specifically it relates to an attachable resistance system for strength training and a technique of working thereof.

BACKGROUND

It has been known for years that strength training builds muscles. Strength training is defined as placing a reasonable amount of resistance on the muscles for a short period of time to cause the muscles to work harder and gain strength, therefore, building the muscles. The most common form of strength training is weightlifting or weight-bearing training. Conventionally weightlifting involves use of weights and other heavy objects to create the resistance needed to build the muscles. However, the conventional apparatus and techniques of strength training do not work well for the desired need.

Various problems may occur, during the course of building muscles using weights, if somebody fails to carry or lift the weights properly including physical injury. Each year thousands of people suffer injuries from weightlifting. There are a number of reasons due to which weight-bearing training may cause injuries. The most common reason for weightlifting injuries is improper use of the weights. Before commencing a weight bearing workout, one should know the proper technique to avoid injuries. Placing too much or misplacing weight will induce inappropriate force on the muscles and bones which may result in substantial pain, discomfort, strains, ruptures or even dislocations.

In light of the foregoing discussion, there is a need for an exercise system for strengthening human muscles that eliminates the aforesaid problems and has low weight, easy operability, requires least training, and requires least space for working, and while still achieving the desired need.

SUMMARY OF INVENTION

An object of the present invention is to provide a wearable muscle strengthening exercise system to build muscles without any use of weights, while achieving a cardiovascular workout at same time. The system could be worn by an individual during aerobics, walking, running, cycling, jogging, or doing menial tasks.

The system has components including, but not limited to, an upper shaft, a lower shaft, a hinge, a pivot, a resistance system, telescopic cups, a stabilizer bar, silicone oil, a circular cavity container, adjustable straps, a center component, adjustable resistance knobs, resistance control plates. Present invention is aimed to provide an exercise system (and a technique of working thereof) that is suitable for easy installation.

Another object of the present invention is to provide the exercise system that has an upper shaft, a lower shaft attached by center component, in between both the shafts. The shafts are positioned to hinge upon the center component, the upper shaft at the top end of the center component and the lower shaft at the bottom center component. The center component is a device which produces resistance to the hinged upper and lower shaft upon moving either shaft. The resistance is produced by means of fluid being compressed inside the center component. The amount of resistance may be adjusted by controlling the clearance with which the fluid inside the center component travels.

Another object of present invention is to provide an attachable exercise system. The system is attached to arm or leg of a human body. For instance, the exercise system can be attached to the arm by strapping the upper shaft to bicep region and the lower shaft to the forearm region of the arm. Upon attaching, the center component would rest in the elbow region of the arm. Upon bending the arm with the said invention affixed, the center component would produce resistance to the upper and lower shaft, thus producing resistance to the arm. This allows the user of said invention to receive the benefits of lifting weights without having to hold weights in their hands or attaching it to their limbs.

Another object of present invention is to provide an easy to use wearable weight training system. The system comprising of an upper shaft, a lower shaft, a resistance controller, and a center component such that the upper shaft and the lower shaft are hinged upon the center component. The center component produces resistance to the hinged upper shaft and the lower shaft when either of the upper shaft or lower shaft is moved or applied resistance. Also, the amount of applied resistance can be adjusted by using the adjustable resistance knobs.

Another object of present invention is to provide a portable exercise system.

Another object of present invention is to provide a wearable exercise system.

Another objective of present invention is to reduce space require to exercise human body.

Yet another objective of present invention is to reduce weight associated with an exercise system.

DETAILED DESCRIPTION OF THE INVENTION

Figure 1:
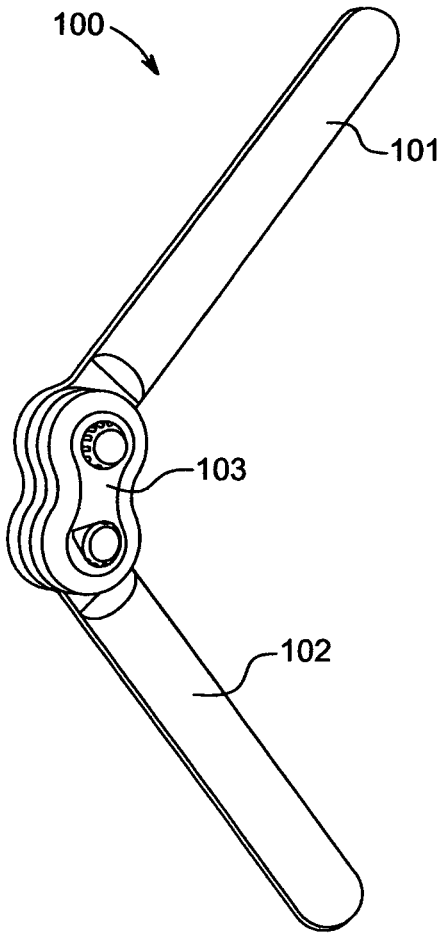
FIG. 1 illustrates an exemplary muscle exercise system, in accordance with an embodiment of the present disclosure.

The present invention is now described with reference to the drawings. While explaining various aspects and features of the invention, like reference numerals are used to refer to like elements and\or structures. Like reference numerals shows the usage of like element in various embodiments of the inventions. The figures, drawings and block diagrams used to explain various embodiments of the present invention are for explanatory purpose and are not limiting of the present invention.

FIG. 1 illustrates an exemplary muscle exercise system diagram, in accordance with an embodiment of the present invention. Muscle exercise system 100 comprises an upper shaft 101, a lower shaft 102, and a center component 103. Upper shaft 101 and lower shaft 102 are placed to hinge upon center component 103 such that upper shaft 101 is positioned at top end of center component 103 and lower shaft 102 is positioned at bottom end of center component 103. Within scope of the present invention, upper shaft 101 and lower shaft 102, are made using one or more of, but not limited to, resilient material, tension cables, plastic, and rubber like material that is designed with a large range of elasticity etc. Upper shaft 101 and lower shaft 102 are attached pivotally to center component 103. Center component 103 is a device which produces resistance to hinged upper shaft 101 and lower shaft 102 in event when any of the two, upper shaft 101 or lower shaft 102 is moved. Both upper shaft 101 and lower shaft 102 can be moved simultaneously. Any movement of upper shaft 101 and lower shaft 102 results in production of resistance to applying force i.e. exercise device 100 is an elongated device that bends upon application of prepositional amount of force.

In another embodiment of the present invention, wherein muscle exercise system 100 is a wearable system and is worn by strapping upper shaft 101 to upper part of an arm of a human body and lower shaft 102 to lower part of the arm of the human body. Upon movement of upper shaft 101 and lower shaft 102, center component 103 would rest in the joint region of the upper arm and the lower arm of the human body, and upon bending or upon stretching, the center component would produce resistance to upper shaft 101 and lower shaft 102, thus producing resistance on the human body region where muscle exercise system 100 was worn.

An advantage of muscle exercise system 100 is that a user of muscle exercise system 100 is able to generate resistance as exercising weights without bearing a heavy load. Therefore, impact and excessive stress placed on the human body with traditional exercising weights can be completely done away with. Reduction in load bearing stress on the human body and increase in mobility by use of portable muscle exercise system 100 gives the user a greater range of motion, therefore, greatly reducing chances for injuries. Objectively, muscle exercise device 100 provides resistance to build and tone muscle mass while performing aerobics, running, bike riding, and performing cardiovascular exercises, etc.

Figure 2:
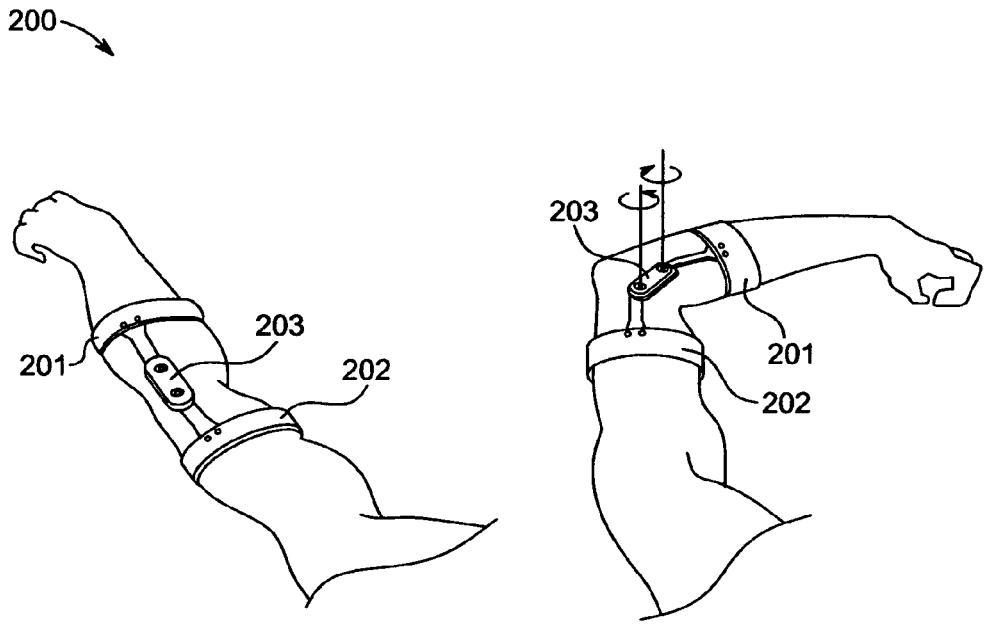
FIG. 2 illustrates a wearable muscle exercise system in accordance with an embodiment of the present disclosure.

FIG. 2 illustrates an exemplary representation of wearable muscle exercise system 200, in accordance with an embodiment of the present invention. As per a preferred embodiment of the present invention, exercise system 200 comprises a lower arm shaft 201, an upper arm shaft 202, and a center component 203. Center component 203 is a device which produces resistance to hinged upper shaft 201 and lower shaft 202 when either upper shaft 201 or the lower shaft 202 is moved. Wearable muscle exercise system 200 is worn by a user or exerciser by strapping upper shaft 201 to bicep region and lower shaft 202 to forearm region of an arm. Upon attaching wearable muscle exercise system 200, center component 203 would rest in elbow region of the arm. Upon bending the arm, center component 203 produces resistance to the upper and lower shafts, thus producing resistance to the arm movement and thereby strengthening muscles. As an advantage, wearable muscle exercise system 200, allows the user to receive benefits of lifting weights without having to hold weights in their hands or attaching it to their limbs.

Figure 3:
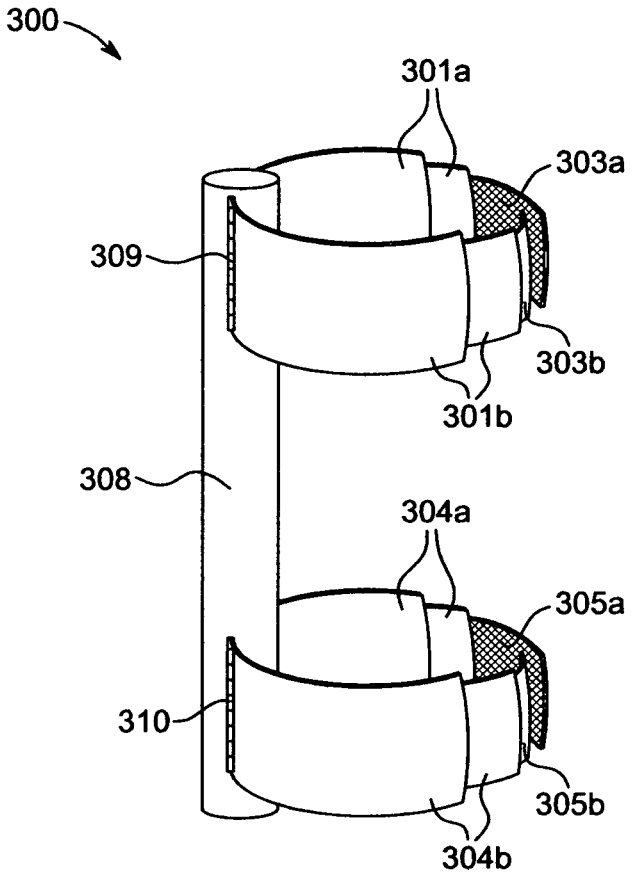
FIG. 3 illustrates a side view of the wearable muscle exercise system in accordance with an embodiment of the present disclosure.

FIG. 3 illustrates an exemplary side view representation of wearable muscle exercise system 300, in accordance with an embodiment of the present invention. Wearable muscle exercise system 300 comprises of telescopic cups 301*a*, 301*b*, 304*a*, and 304*b*, adjustable straps 303*a*, 303*b*, 305*a*, and 305*b*, hinge support 309 and 310, and stabilizer bar 308. The telescopic cups 301*a*, 301*b* are used to cup the upper arm and telescopic cups 304*a* and 304*b* are used to cup the lower arm of the user of the wearable muscle exercise system 300. The telescopic cups are made up of, but not limited to, hard plastic material, elastic material, and metal etc. Adjustable straps 303*a* and 303*b* are used to adjust or tighten telescopic cups 301*a* and 301*b* to the upper arm and adjustable straps 305*a* and 305*b* are used to adjust or tighten telescopic cups 304*a* and 304*b* to the lower arm of wearable muscle exercise system 300. Adjustable straps 303*a*, 303*b*, 305*a*, and 305*b* are made of, but not limited to, durable nylon like materials having limited elasticity. The adjustable straps are attached to the telescopic cups which are positioned at top and bottom portion of the stabilizer bar 308 of the wearable muscle exercise system 300. Further, hinge support 309 and 310 are used to provide connection and support to telescopic cups 301*a* and 301*b* at top end of the stabilizer bar 308 and telescopic cups 304*a* and 304*b* at bottom end of the stabilizer bar 308. The top end of stabilizer bar 308 is hinged with telescopic cups 301*a* and 301*b* to fix the upper portion of the body and the bottom end of stabilizer bar 308 is hinged with telescopic cups 304*a* and 304*b* to fix the lower portion of the body.

In a preferred embodiment of the present invention, stabilizer bar 308 is a center component which enables movement of first portion and second portion of wearable muscle exercise system 300 wherein the first portion comprises of telescopic cups 301*a* and 301*b*, adjustable straps 303*a* and 303*b*, and hinge support 309 and the second portion comprises of telescopic cups 304*a* and 304*b*, adjustable straps 305*a* and 305*b* and hinge support 310. The wearable muscle exercise system 300 with the telescopic cups can be worn by the user on an arm, leg, waist, or shoulder to achieve desired outcome during various exercises such as, weightlifting, walking, running, cycling, riding, and fitness training, and other muscular workout.

Figure 4:
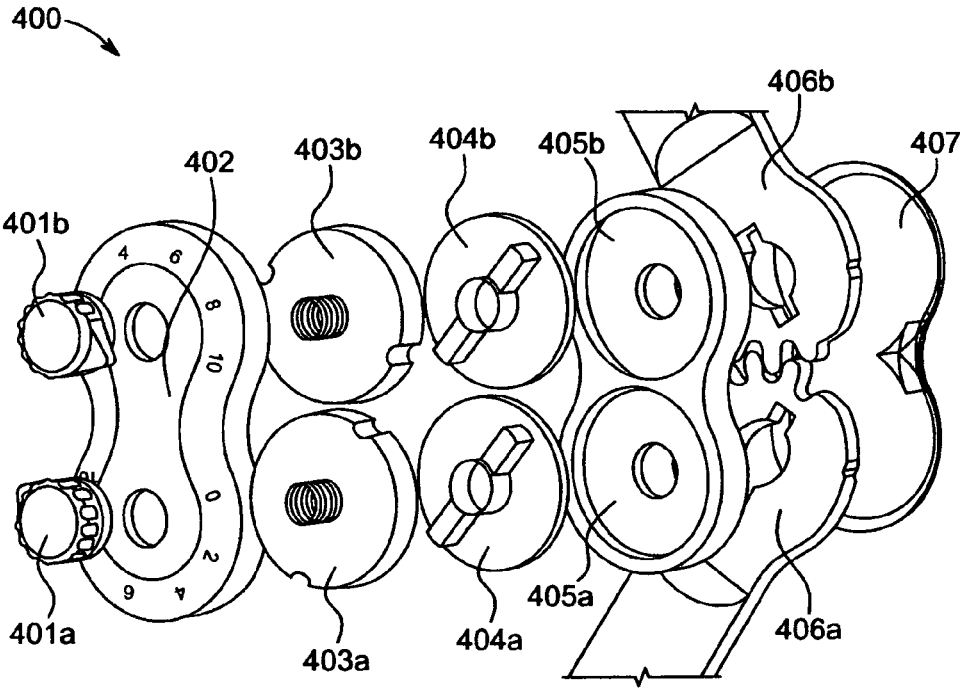
FIG. 4 illustrates center component of the wearable muscle exercise system in accordance with an embodiment of the present disclosure.

FIG. 4 illustrates an exemplary representation of the center component of the wearable muscle exercise system, in accordance with an embodiment of the present invention. In wearable muscle exercise system 300, center component 400 comprises of adjustable knobs 401*a* and 401*b*, a resistance control indicator plate 402 with resistance levels indicated, spiral tipped circular plates 403*a* and 403*b*, ridged circular plates 404*a* and 404*b*, circular cavity plates 405*a* and 405*b* for containing fluid, a upper shaft 406*a* with interlocking teeth, a lower shaft 406*b* with interlocking teeth, and a back closing pocket 407.

Adjustable knobs 410*a* and 401*b* are tightened on resistance control indicator plate 402 using spiral tips of spiral tipped circular plates 403*a* and 403*b* and ridged circular plates 404*a* and 404*b*. Ridged circular plates 404*a* and 404*b* are fitted in circular cavity plates 405*a* and 405*b* and operationally connected with upper shaft 406*a* interlocking teeth and lower shaft 406*b* with interlocking teeth with support of back closing pocket 407. Back closing pocket 407 provides surface support to the interlocking shafts, upper shaft 406*a* and lower shaft 406*b*.

Adjustable knobs 401*a* and 401*b* are used for setting various resistance levels on resistance control plate 402 for producing higher resistance or lower resistance as needed by the exerciser or the user of the wearable muscle exercise device 300. In one embodiment, the various resistance levels on resistance control plate 402 are exemplary represented in the form of numbers i.e. 1, 2, 3 . . . 10. In another embodiment, the various resistance levels on resistance control plate 402 are marked as Low L, Medium M, and High H. Adjustable knobs 401*a* and 401*b* are axially rotated over resistance control plate 402 to set targeted level of resistance. Adjustable knobs 401*a* and 401*b* are used to provide the desired amount of resistance needed by the exerciser by rotating adjustable knobs 401*a* and 401*b*, which is responsible to produce the amount of resistance requisite in lower shaft 404*a* and upper shaft 404*b*.

Adjustable knobs 401*a* and 401*b* are connected to the spiral tip of circular plates 403*a* and 403*b* for compressing the fluid present in circular cavity plates 405*a* and 405*b* through ridged circular plates 404*a* and 404*b*. The circular plates with ridges 404*a* and 404*b* are used to control the compression and clearance level at which the fluid travels in circular cavity plate 405*a* and 405*b*. The circular plates and ridges can be of any shape and size. Circular cavity plates 405*a* and 405*b* contains the fluid. The fluid used in circular cavity plates 405*a* and 405*b* is silicone oil, or any kind of lubricant used mostly in exercise systems for producing resistance. Upper shaft 406*a* and lower shaft 406*b* with interlocking tooth moves when the exerciser or the user bends or stretches the wearable muscle exercise system 300 during exercise. The shape and size of the shafts and the interlocking teeth shown in the FIG. 4 form part of an embodiment of the present invention and should not be considered as limitation on scope of the present invention.

The above presents a description of the best mode contemplated for carrying out the individual muscle exercise system, and of the manner and process of making and using it, in such full, clear, concise, and exact terms as to enable any person skilled in the art to which it pertains to make and use this muscle exercise system. This muscle exercise system is, however, susceptible to modifications and alternate constructions from that discussed above that are fully equivalent. Consequently, this muscle exercise system is not limited to the particular embodiments disclosed. On the contrary, this muscle exercise system covers all modifications and alternate constructions coming within the spirit and scope of the muscle exercise system as generally expressed by the following claims, which particularly point out and distinctly claim the subject matter of the muscle exercise system.

Thus, a wearable muscle exercise system has been described. It would be evident to person skilled in the art that various modification and changes may be made to these embodiments without departing from the broad spirit and scope of the invention. Further, the described embodiments and the drawings are to be considered only as illustrative and not restrictive.

I claim:

1. An apparatus, the apparatus comprising:

at least one resistance adjustable knob;

at least one resistance control indicator;

at least one spiral tipped circular plate;

at least one ridged circular plate;

at least one circular cavity plate containing lubricating fluid;

at least one shaft with interlocking teeth;

at least one closing pocket;

wherein, the at least one resistance adjustable knob is connected to the at least one resistance control indicator plate using the at least one spiral tipped circular plate and the at least one ridged circular plate such that the at least one ridged circular plate is connected with the at least one circular cavity plate and with the at least one shaft with interlocking teeth;

wherein, the at least one resistance control indicator plate is operably connected with the at least one closing pocket, wherein the at least one ridged circular plate controls the compression and clearance level of the lubricating fluid travels within the at least one circular cavity plate.

2. The apparatus of claim 1, wherein the at least one resistance adjustable knob has axial rotation.

3. An apparatus comprising:

a first arm and a second arm rotatably connected to each other through interlocking tooth grooves;

a resistance component operably secured to apply resistance to the rotation of the first arm with respect to the second arm, the resistance component comprising:

at least one cavity plate operably engaged with the first arm and the second arm, the at least one cavity plate containing a volume of lubricating fluid;

at least one ridged circular plate to control a compression and clearance level of the lubricating fluid in the at least one cavity plate;

at least one spiral tipped circular plate to apply the compression force to the lubricating fluid through the at least one ridged circular plate; and at least one resistance adjustment knob to adjust and control the amount of the compression force applied by the at least one spiral tipped circular plate to the at least one compression control plate;

wherein, an increase in the amount of compression force causes an increased resistance to the rotation of the first arm with respect to the second arm.

* * * * *